US005971647A

United States Patent [19]

Loulourgas

[11] Patent Number: 5,971,647

[45] Date of Patent: Oct. 26, 1999

[54] WRITING DEVICE CAP

[76] Inventor: Demetre Loulourgas, 1540 Gulf Blvd., Penthouse 7, Ultimar 2, Clearwater, Fla. 34630

[21] Appl. No.: 09/076,398

[22] Filed: May 12, 1998

[51] Int. Cl.[6] ..... B43K 9/00

[52] U.S. Cl. ..... 401/202; 401/246

[58] Field of Search ..... 401/202, 213, 401/243, 245, 246, 247

[56] References Cited

U.S. PATENT DOCUMENTS

| | | | |
|---|---|---|---|
| 1,075,631 | 10/1913 | Dods | 401/246 |
| 3,458,267 | 7/1969 | Larson | 401/213 |
| 3,502,417 | 3/1970 | Hartmann | 401/202 |
| 4,380,403 | 4/1983 | Endres et al. | 401/202 |
| 4,759,651 | 7/1988 | Manusch et al. | 401/247 |
| 4,979,840 | 12/1990 | Madaus et al. | 401/202 |
| 5,000,603 | 3/1991 | Isoda | 401/202 |
| 5,551,789 | 9/1996 | Okawa et al. | 401/202 |

FOREIGN PATENT DOCUMENTS

| | | | |
|---|---|---|---|
| 827760 | 12/1951 | Germany | 401/246 |
| 945818 | 6/1956 | Germany | 401/246 |
| 2249526 | 5/1992 | United Kingdom | 401/213 |

*Primary Examiner*—Charles R. Eloshway
*Attorney, Agent, or Firm*—Larson & Larson, P.A.; James E. Larson

[57] ABSTRACT

A writing device cap comprises a cylindrical outer housing having a first open end, a second closed end and an axial channel. A plug is inserted in the outer housing second closed end. A moveable inner cone located within the cylindrical outer housing receives a tip of a writing device and seals it from the ambient atmosphere. A spring surrounds the inner cone and facilitates it movement. A plurality of radially disposed ridges are arranged along an inner circumference of the outer housing along the axial channel. Multiple sets of shoulders are disposed upon the ridges. A first set of shoulders provides a stop for a body trunk of the writing device and a means to locate the inner cone when the spring is in a relaxed state. A second set of shoulders locates a fixed end of the spring. A third set provides a means for locking the plug within the outer housing. A latch mechanism holds the writing device in the cap when the spring is in a compressed state. A plurality of air vents formed on the plug permit air to pass through the cap in case it accidentally swallowed and lodged in the throat of a person.

20 Claims, 5 Drawing Sheets

WRITING DEVICE CAP

BACKGROUND OF THE INVENTION

1. Field of the Invention

The present invention relates to a cap for a writing device. More particularly, it relates to a cap having an inner conical portion for sealing the tip of an ink-type writing device within the writing device cap thereby prohibiting the tip from drying out.

2. Description of the Prior Art

Caps for writing devices are well known in the prior art. For many years, writing device caps, and more particularly, caps for ink-type pens, were constructed simply as a single cap housing. The single cap housing would slip over the tip of a pen to protect the tip and to avoid unintentional marking of objects that the pen came into contact with (for instance, marking the shirt pocket of the pen user). Unfortunately, such these prior art caps permit ambient air to easily seep into the air chamber within the cap and quickly dry out the pen tip. Once the tip drys out, the pen is ruined and must be discarded.

In an effort to increase the life-span of ink-type writing devices, improvements on the basic design cap were made. The improved caps employed a sealed inner chamber disposed within the outer cap housing, such that the pen tip would be separately located from any air trapped within the writing device cap. Unfortunately, the improved caps could be lethal if lodged in the throat of a person, especially a child, in that the non-passages of air through the cap could cause suffocation. For this reason, an improved cap was needed.

It was thereafter discovered that air vents formed in the cap head facilitate the passage of air through the cap. If a cap is accidentally swallowed, air is still permitted to move through the wind pipe of the person, even if the cap is lodged in the throat. But, such devices have caused an earlier problem to reappear. Namely, the air vents permit ambient air to come into contact with the tip of the writing device and cause the tip to dry-out. Some inventors have attempted to alleviate the resurrected drying-out problem by employing a fixed inner seal within the cap outer housing. But, improvements are still needed. More particularly, a superior cap is needed for an ink-type writing device which permits air-flow to pass therethrough but adequately seals the device tip from the ambient atmosphere so as to prevent premature drying-out of the writing device tip.

SUMMARY OF THE INVENTION

I have invented a novel cap for writing devices that solves the problems inherent in the prior art. My cap permits an adequate amount of air to flow through the cap in case of accidental swallowing of the cap by a person, while providing a superior sealing means, not seen in the prior art, which prohibits the writing device tip from drying-out prematurely due to the ambient air passing through the cap.

The cap of the present invention employs an outer housing having a first open end. A second closed end has a plug portion inserted therein. The first open end and second closed end define an axial channel. A conically shaped, spring-actuated, inner seal portion moves about the axial channel in response to pressure inserted thereto. Pressure is applied at a large graduated, annular open end of the inner seal portion by the tapered end of a writing device, as a tip portion of the writing device is inserted into the inner seal portion. A spring surrounding the inner seal portion, and in communication therewith, facilitates the movement of the inner seal portion. A first set of shoulders, attached within an inner circumference of the outer housing, upon a plurality of radially disposed ridges, proximal to the inner seal portion, provide a stopping means for the inner seal portion when the pen body is removed from the cap. The spring affects movement of the inner seal portion in an outward direction towards the outer housing first open end, when the pen body is removed. A flange of the inner seal portion communicates with the first set of shoulders thereby stopping the inner seal portion at a fixed point. The conical shape of the inner seal portion facilitates the tight seal between the tapered end of the pen and the inner seal portion to prohibit premature drying-out of its tip. A plurality of air vents formed in the plug portion permit the passage of air to flow from the second closed end, around the inner seal portion, through the cap axial channel and out the first open end of the outer housing.

BRIEF DESCRIPTION OF THE DRAWINGS

The invention may be best understood by those having ordinary skill in the art by reference to the following detailed description when considered in conjunction with the accompanying drawings in which.

SPECIFIC DESCRIPTION OF THE PREFERRED EMBODIMENTS

Figure 1:
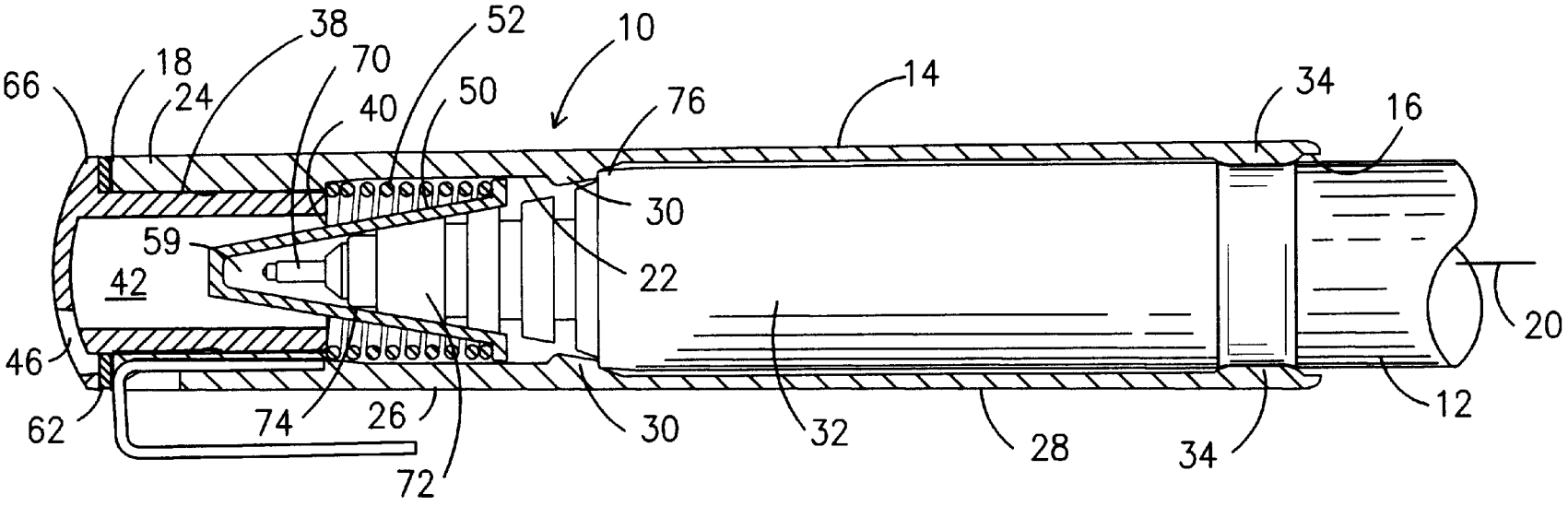
FIG. 1 is a cross-sectional view of a writing device cap of the present invention depicting a writing device inserted within the cap.

Referring to FIG. 1, a cap 10 is receiving a writing device 12. Cap 10 has a cylindrical outer housing 14 having first and second ends, 16 and 18 respectively, and an inner circumference 22. First and second ends 16 and 18 define an axial channel 20. Writing device 12 inserts into cap 10 along axial channel 20. Outer housing 14 generally has three portions: top portion 24, intermediate portion 26 and bottom portion 28.

Figure 3:
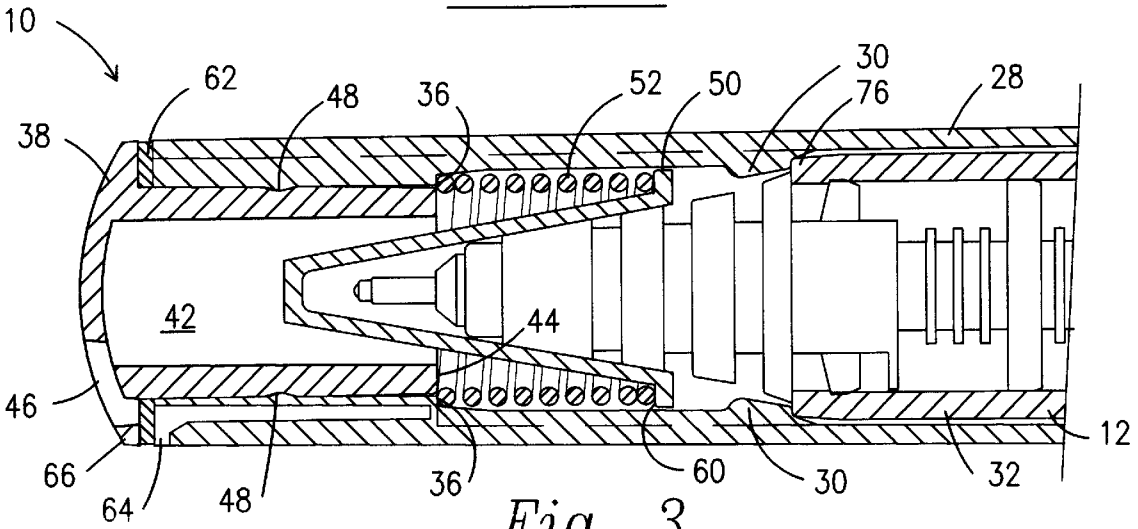
FIG. 3 is a detailed cross-sectional view of the writing device cap depicting a tip portion of the writing device inserted within the cap.
Figure 4:
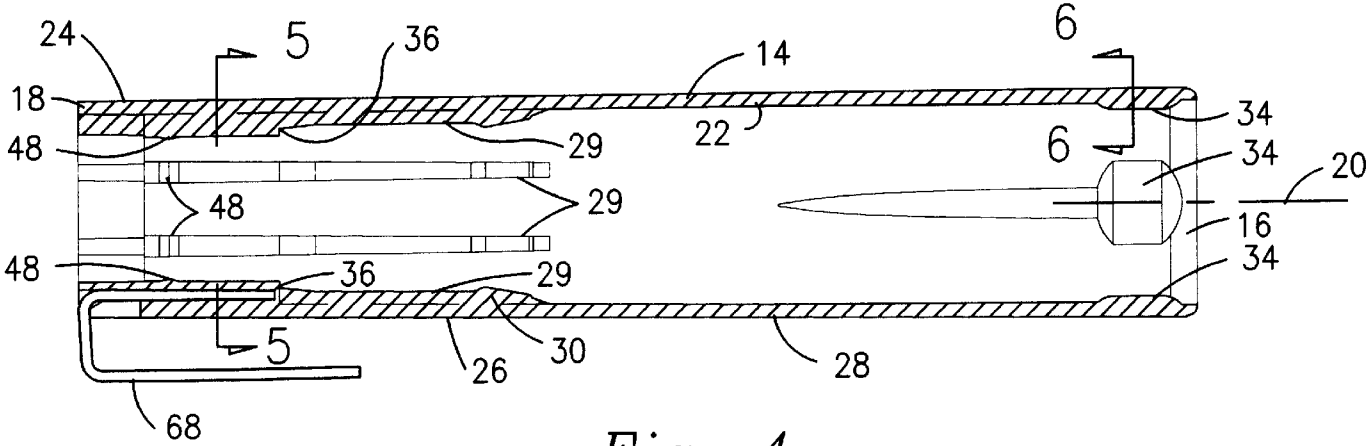
FIG. 4 is a cross-sectional view of the writing device cap having a plug portion removed from a second end of the cap.

Referring to FIG. 4, a plurality of radially disposed ridges 29 are arranged along outer housing inner circumference along axial channel 20. In the preferred embodiment, six radially disposed ridges are employed. A first set of shoulders 30 are disposed upon ridges 29 at a point between bottom portion 28 and intermediate portion 26. In the preferred embodiment six first shoulders are employed. As seen in FIGS. 1 and 3, first set of shoulders 30 provide a stop for a body trunk 32 of writing device 12.

Figure 6:
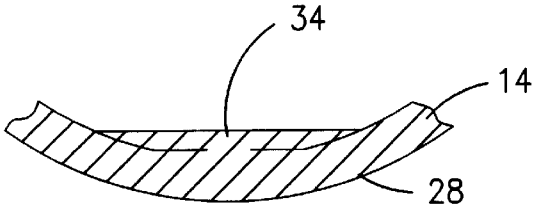
FIG. 6 is a cross-sectional view along lines 6—6 of FIG. 4.
Figure 5:
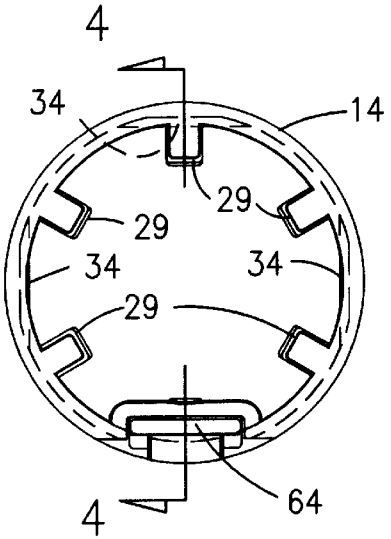
FIG. 5 is a cross-sectional view along lines 5—5 of FIG. 4.

Continuing with FIG. 4, a set of radially disposed latches 34 are arranged at a point along inner circumference 22 proximal to outer housing first end 16. In the preferred embodiment, four latches are employed. The thickness of cylindrical outer housing 14 at a point where latches 34 are located upon inner circumference 22 has a thickness slightly greater than that of bottom portion 28 (see FIG. 6) and provides a latch mechanism for cap 10 to frictionally secure cap 10 to writing device body trunk 32 (see FIG. 1).

Figure 2:
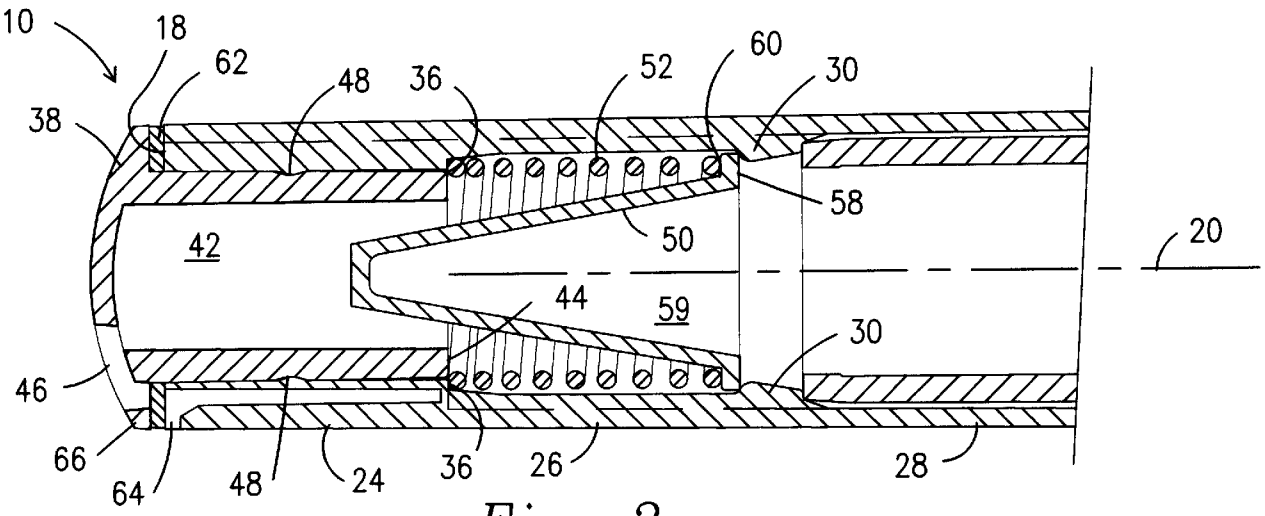
FIG. 2 is a detailed cross-sectional view of the writing device cap.

Referring to FIGS. 2–4, a second set of shoulders 36 is disposed upon ridges 29 at a point between intermediate portion 26 and top portion 24. In the preferred embodiment six second shoulders are employed. The thickness of ridge 29 and second shoulder 36 disposed thereupon is greater than the thickness of ridge 29 by itself.

Figure 8:
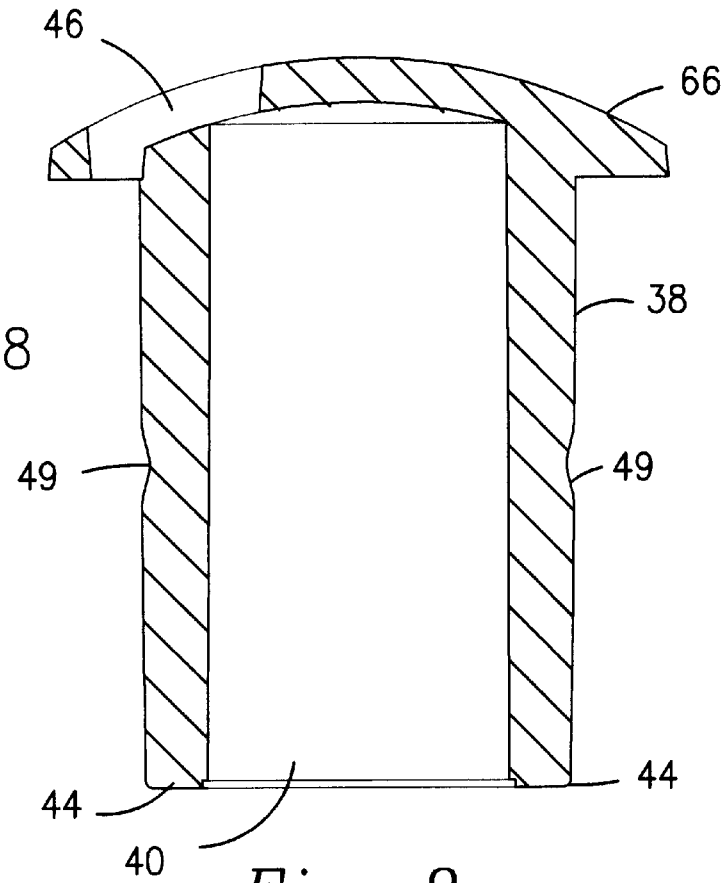
FIG. 8 is a cross-sectional view of the plug portion along lines 8—8 of FIG. 7.
Figure 7:
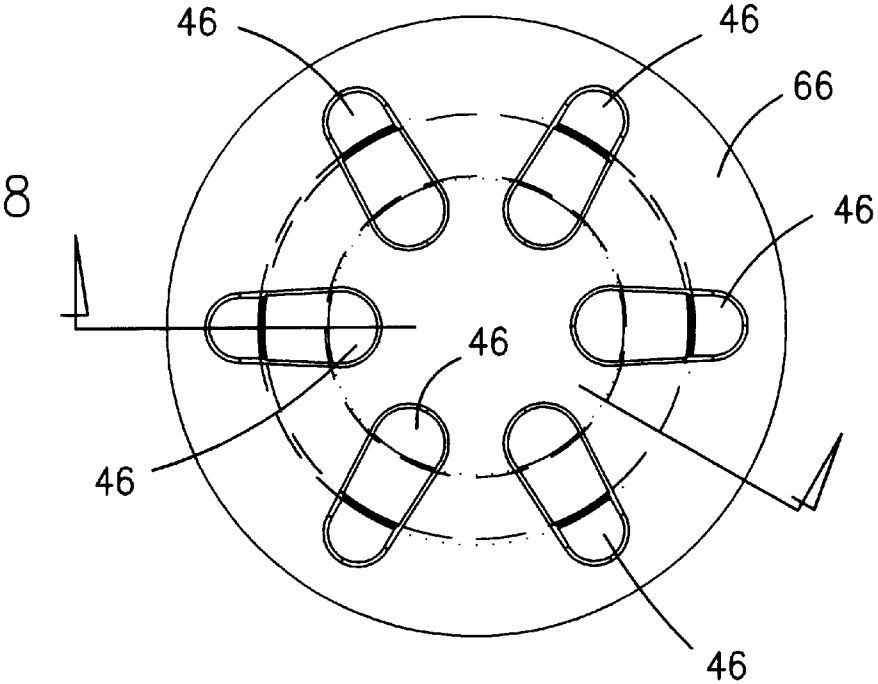
FIG. 7 a top plan view of the plug portion used to close a second end of an outer housing of the cap.
Figure 9:
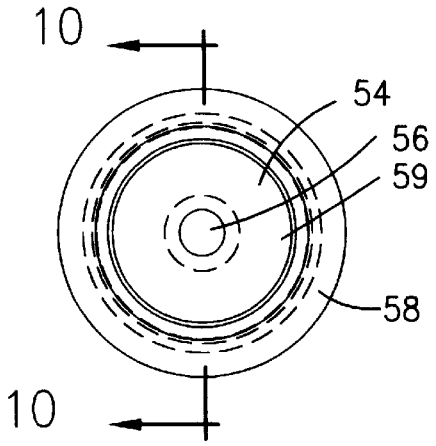
FIG. 9 is a bottom plan view of a conically shaped inner sealing portion used with the writing device cap to receive and seal therewithin the tip portion of the writing device.

Referring to FIG. 8, a plug 38, having an open end 40 and an annular foot 44, is shown. Plug 38 inserts within outer housing second end 18 along axial channel 20 as shown in FIG. 1. When inserted, plug 38 defines a first airspace 42 within outer housing axial channel 20. As seen in FIG. 2, plug annular foot 44 aligns with the set of second shoulders 36 along a line perpendicular to axial channel 20. Plug 38 additionally employs a plurality of air vents 46 (see FIG. 7). In the preferred embodiment, six air vents are employed. Air vents 46 permit ambient air to flow therethrough, around all internal components of cap 10 and out through outer housing first end 16. Such a configuration proves to be advantageous if cap 10 is accidentally swallowed and lodged in the throat of a person. If an accidental lodging occurs, air vents 46 would permit a sufficient amount of air to pass through cap 10 thereby avoiding the asphyxiation of the person.

Referring to FIGS. 2–4, a set of radially disposed bosses 48 are shown. In the preferred embodiment, six bosses are employed. Bosses 48 are generally located at a center point of top portion 24 upon ridges 29. Bosses 48 protrude upward from ridges 29 and engage an annular groove 49 (see FIG. 8) of plug 38 when plug 38 is inserted within outer housing second end 18. Such ridge-to-groove engagement frictionally locks plug 38 within outer housing 14 (see FIGS. 2 and 3).

Figure 10:
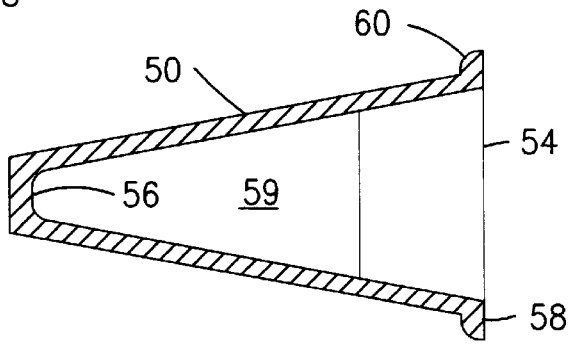
FIG. 10 is a cross-sectional view of the inner sealing portion along lines 10—10 of FIG. 9.
Figure 11:
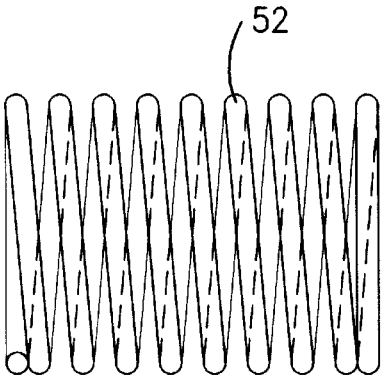
FIG. 11 is a side elevational view of a spring used in the cap of the present invention for surrounding the inner sealing portion and facilitating its movement within the cap.
Figure 12:
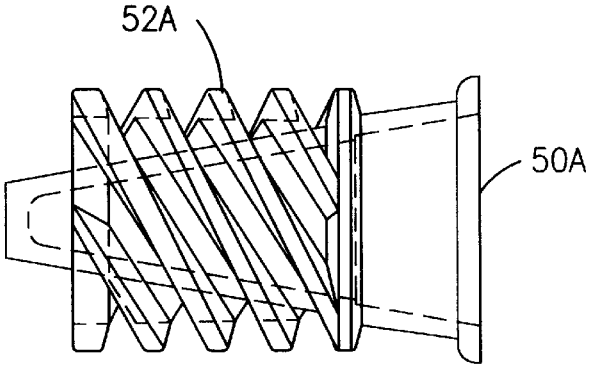
FIG. 12 is a side elevational view of an alternate spring used in the cap of present invention, the spring being integral with the inner sealing portion.

Referring to FIGS. 1–3, a conically shaped inner sealing portion 50 is shown. Inner sealing portion 50 is surrounded by spring 52 which facilitates movement of inner sealing portion 50. In the preferred embodiment, spring 52 is a separate element: having nine coils, as shown in FIG. 11. In an alternate embodiment, a integrally attached plastic spring 52A is employed with inner sealing portion 50A, as shown in FIG. 12. As shown in FIG. 10, inner sealing portion 50 has a first open end 54, a second closed end 56, annular flange 58 of first open end 54 and a second airspace 59, separate from first airspace 42. Referring to FIGS. 2 and 3, it is shown that inner sealing portion 50 moves within axial channel 20 between intermediate and top portions 26 and 24 respectively in response to axial pressure applied thereto. When spring 52 is in a relaxed state (see FIG. 2), annular flange 58 rests against the first set of shoulders 30. As axial pressure is applied inwardly, spring 52 compresses and moves inner sealing portion 50 towards outer housing second closed end 18 into first airspace 42 (see FIG. 3). The second set of shoulders 36 and plug annular foot 44 hold a fixed end of spring 52 in place. An opposed end of spring 52 rests upon a top side 60 of annular flange 58. As axial pressure is removed, spring 52 returns to a relaxed state of FIG. 2.

Referring to FIG. 1, a washer 62 is shown positioned between a head portion 66 of plug 38 and outer housing second end. 18. Washer 62 can be colored to indicate the color of ink used in writing device 12. Referring to FIGS. 2 and 3, a clip channel 64 is formed in outer housing 14 proximal to outer housing second end 18. A clip 68 is inserted into clip channel 64, as shown in FIG. 4, to provide a means for clipping writing device 12 to a shirt pocket (not shown), for instance. Clip 68 in frictionally retained in clip channel 64.

Referring to FIG. 1, it is shown how writing device 12 is inserted and retained in cap 10. A tip 70 of writing device 12 is inserted into axial channel 20 such that tip 70 enters second airspace 59. Writing device 12 has an annular tapered end 72 which has a downwardly graduating slope similar to that of an inner circumference 74 of inner sealing portion 50. Tapered end 72 mates with inner sealing portion inner circumference 74 and causes writing device 12 to come to a stop. As inwardly axial pressure is continually applied, inner sealing portion 50 applies pressure to spring 52 at flange top side 60 causing spring 52 to compress, as seen in FIG. 3. A top end 76 of writing device body trunk 32 stops against the first set of shoulders 30. Latches 34 frictionally engage body trunk 32 so that the outwardly applied pressure of compressed spring 52 does not eject writing device 12 from cap 10, as shown in FIG. 1. The shape of writing device tapered end 72 mating against inner sealing portion inner circumference 74 provides a generally airtight seal. Accordingly, tip 70 is sealed from the ambient atmosphere surrounding inner sealing portion 50. Such a seal prevents tip 70 from drying-out prematurely.

Of course, various changes, modifications and alterations may be contemplated by those skilled in the art without departing from the intended spirit and scope thereof. As such, it is intended that the present invention only be limited by the terms of the appended claims.

Having thus described the invention what is claimed and desired to be secured by Letters Patent is:

1. A cap for surrounding a tip of a writing device such that the tip is sealed in an airtight compartment, the cap comprising:

a) a cylindrical outer housing having a first open end, a second closed end, and an inner circumference, the first and second ends defining an axial channel of the cap, b) a cylindrical plug inserted within the outer housing second end along the axial channel, the plug defining a first airspace within the cap axial channel, c) a conically shaped inner sealing portion moveable within the cap along the axial channel, the inner sealing portion having a first open end, a second closed end and an annular flange of the first open end, the inner sealing portion first and second ends defining a second airspace separate from the first airspace of the plug, the second airspace for receiving the writing device tip and sealing it from the ambient atmosphere, d) a spring surrounding the inner sealing portion for facilitating the movement of the inner sealing portion, e) a plurality of ridges radially disposed upon the inner circumference of the outer housing along the axial channel proximal to the outer housing second end, f) a plurality of first shoulders disposed upon the plurality of ridges for abutting the flange of the inner sealing portion when the spring is in a relaxed state, g) a plurality of second shoulders disposed upon the plurality of ridges for supporting a fixed end of the spring, the plurality of second shoulders positioned generally intermediate the plurality of first shoulders and the outer housing second closed end, and h) a plurality of air vents formed in the plug for permitting ambient air to flow through the air vents, around the inner sealing portion, through the axial channel and out the outer housing first open end when the cap is not receiving a writing device body trunk and tip.

2. The writing device cap of claim 1, further comprising a plurality of latches radially disposed along the inner circumference of the outer housing proximal to the outer housing first open end, the plurality of latches for engaging the writing device body trunk.

3. The writing device cap of claim 1, further comprising a channel formed in the outer housing proximal to the outer housing second closed end, the channel frictionally receiving a clipping mechanism for permitting the writing device to be clipped to a pocket when the cap is inserted over the writing device tip.

4. The writing device cap of claim 1, wherein the outer housing has a top, intermediate and bottom portion.

5. The writing device cap of claim 4, wherein the plurality of first shoulders defines a point between the bottom and intermediate portions.

6. The writing device cap of claim 4, wherein the plurality of second shoulders defines a point between the intermediate and top portions.

7. The writing device cap of claim 4, wherein the thickness of the plurality of ridges at the outer housing top portion is greater than the thickness of the plurality of ridges at the outer housing intermediate portion.

8. The writing device cap of claim 4, wherein the inner circumference of the outer housing bottom portion has a thickness less than the thickness of the inner circumference at the locations of the plurality of ridges disposed upon the outer housing at the intermediate and top portions.

9. The writing device cap of claim 4, further comprising a plurality of bosses radially disposed along the inner circumference of the outer housing at the top portion.

10. The writing device cap of claim 9, wherein the cylindrical plug has an annular groove formed along an outer circumference of the plug, the annular groove receiving the plurality of bosses, frictionally securing the plug within the cap outer housing second end.

11. The writing device cap of claim 1, wherein the spring is integrally formed as part of the conically shaped inner sealing portion.

12. The writing device cap of claim 1, wherein six air vents are employed.

13. The writing device cap of claim 1, wherein the conically shaped inner sealing portion is formed to communicate with a tapered end of the writing device such that the tip of the writing device is sealed within the second airspace and proximately spaced from the second closed end of the inner sealing portion, an inner circumference of the inner sealing portion juxtaposally abutting a downwardly graduating outer circumference of the writing device tapered end when the cap is inserted over the writing device.

14. A cap for surrounding a tip of a writing device such that the tip is sealed in an airtight compartment, the cap comprising:

a) a cylindrical outer housing having a top, intermediate and bottom portion, a first open end, a second closed end, and an inner circumference, the first and second ends defining an axial channel of the cap, b) a cylindrical plug inserted within the outer housing second end along the axial channel, the plug defining a first airspace within the cap axial channel, c) a conically shaped inner sealing portion moveable within the cap along the axial channel, the inner sealing portion having a first open end, a second closed end and an annular flange of the first open end, the inner sealing portion first and second ends defining a second airspace separate from the first airspace of the plug, the second airspace for receiving the writing device tip and sealing it from the ambient atmosphere, d) a spring surrounding the inner sealing portion for facilitating the movement of the inner sealing portion, e) six ridges radially disposed upon the inner circumference of the outer housing along the axial channel proximal to the outer housing second end, f) six first shoulders disposed upon the six ridges for abutting the flange of the inner sealing portion when the spring is in a relaxed state, g) six second shoulders disposed upon the six ridges for supporting a fixed end of the spring, the six second shoulders positioned generally intermediate the six first shoulders and the outer housing second closed end, h) four ridges radially disposed upon the inner circumference of the outer housing along the axial channel proximal to the outer housing first open end, the four ridges providing a latch for the cap to engage a body trunk of the writing device, i) six bosses disposed upon the six ridges proximal to the outer housing second closed end, j) an annular groove formed along an outer circumference of the plug, the annular groove receiving the six bosses, frictionally securing the plug within the cap outer housing second end, and k) a plurality of air vents formed in the plug for permitting ambient air to flow through the air vents, around the inner sealing portion, through the axial channel and out the outer housing first open end when the cap is not receiving the writing device body trunk and tip.

15. The writing device cap of claim 14, wherein the location of the six first shoulders defines a point between the outer housing bottom and intermediate portions and the location of the six second shoulders defines a point between the outer housing intermediate and top portions.

16. The writing device cap of claim 14, wherein the spring is an integrally formed plastic spring.

17. The writing device of claim 14, wherein the spring has nine coils.

18. A writing apparatus comprising:

a) a cylindrical member having a first and second end, a body trunk, a tapered portion and an aperture formed in the first end, the first and second ends defining an internal channel, the tapered portion being proximal to the first end, b) an ink cartridge having a tip portion inserted within the internal channel of the cylindrical member, the tip portion protruding through the aperture in the cylindrical member first end, c) a cap portion comprising a cylindrical outer housing having a first open end, a second closed end, and an inner circumference, the first and second ends defining an axial channel of the cap portion, d) a cylindrical plug inserted within the cap portion outer housing second end along the axial channel, the plug defining a first airspace within the cap portion axial channel, e) a conically shaped inner sealing portion moveable within the cap portion along the axial channel, the inner sealing portion having a first open end, a second closed end and an annular flange of the first open end, the inner sealing portion first and second ends defining a second airspace separate from the first airspace of the plug, the second airspace for receiving the ink cartridge tip and sealing it from the ambient atmosphere, f) a spring surrounding the inner sealing portion for facilitating the movement of the inner sealing portion, g) a set of ridges radially disposed upon the inner circumference of the cap portion outer housing along the axial channel proximal to the outer housing second end, h) a first set of shoulders disposed upon the set of ridges for abutting the flange of the inner sealing portion when the spring is in a relaxed state, i) a second set of shoulders disposed upon the set of ridges for supporting a fixed end of the spring, the second set of shoulders positioned generally intermediate the first set of shoulders and the cap portion outer housing second closed end, j) a set of latches radially disposed upon the inner circumference of the outer housing along the axial channel proximal to the outer housing first open end, the set of latches for engaging the cylindrical member, k) a set of air vents formed in the plug for permitting ambient air to flow through the air vents, around the inner sealing portion, through the axial channel and out the cap portion outer housing first open end when the cap portion is not receiving the cylindrical member and ink cartridge tip portion, and l) the conically shaped inner seal portion of the cap portion formed to communicate with the tapered portion of the cylindrical member such that the tip portion of the ink cartridges is sealed within the second airspace and proximately spaced from the second closed end of the inner sealing portion, an inner circumference of the inner sealing portion juxtaposally abutting a downwardly graduating outer circumference of the cylindrical member tapered portion when the cap portion is inserted over the cylindrical member.

19. The writing apparatus of claim 18, wherein six ridges are employed.

20. The writing apparatus of claim 18, wherein four latches are employed.

* * * * *